United States Patent [19]

Rudell

[11] Patent Number: 4,776,597

[45] Date of Patent: Oct. 11, 1988

[54] GAME BOARD AND PLAYING PIECES

[76] Inventor: Elliot A. Rudell, 2215 237th St., Torrance, Calif. 90501

[21] Appl. No.: 910,148

[22] Filed: Sep. 22, 1986

Related U.S. Application Data

[63] Continuation-in-part of Ser. No. 437,687, Oct. 29, 1982.

[51] Int. Cl.[4] ..... A63F 3/00

[52] U.S. Cl. ..... 273/241; 273/282; 273/290; 273/272

[58] Field of Search ..... 273/282 B, 282 R, 290, 273/272, 241, 288, 271; 446/117, 118, 86

[56] References Cited

U.S. PATENT DOCUMENTS

| | | | |
|---|---|---|---|
| 2,278,894 | 4/1942 | Paulson | 446/117 |
| 2,757,934 | 8/1956 | Dunbar | 273/282 B |
| 3,462,150 | 8/1969 | Ericksson | 273/282 B |
| 4,249,336 | 2/1981 | Moe et al. | 446/118 |

FOREIGN PATENT DOCUMENTS

| | | | |
|---|---|---|---|
| 1270021 | 7/1961 | France | 273/290 |
| 2951790 | 7/1980 | Fed. Rep. of Germany | 273/284 |
| 16560 | of 1905 | United Kingdom | 273/290 |
| 476919 | 12/1937 | United Kingdom | 273/282 B |

*Primary Examiner*—Anton O. Oechsle
*Assistant Examiner*—Benjamin Layno
*Attorney, Agent, or Firm*—Plante, Strauss & Vanderburgh

[57] ABSTRACT

There is disclosed a game board with playing pieces in which the game board is provided with a plurality of square bosses arranged in a waffle pattern. The playing pieces are each provided with a peripheral skirt about their lower edge and an offset shoulder about their upper edge. The bosses and playing pieces are square and are of the same shape so that the playing pieces can be stacked on a respective boss of the board and on each other.

6 Claims, 1 Drawing Sheet

GAME BOARD AND PLAYING PIECES

RELATED APPLICATIONS

This application is a continuation-in-part of my earlier filed application, Ser. No. 437,687, filed Oct. 29, 1982 for my new design of a game board and playing pieces.

BACKGROUND OF THE INVENTION

1. Field of the Invention

This invention relates to a game board and playing pieces and, in particular, to the combination of a game board and playing pieces for playing a word game.

2. Brief Statement of the Prior Art

Word games, such as those in which words must be formed from a limited number of letters, have been popular for a long time. In the typical word game, several players are provided with randomly chosen letters and each player endeavors to complete the spelling of one or more words from those letters, usually by building new words that intersect words previously spelled during the progress of the game. The winner of the game is the player who assembles the greatest number of words and words of greatest complexity or length. The game is commonly played on a smooth, flat game board or table and each player can assemble words in each of two dimensions on the playing surface.

BRIEF STATEMENT OF THE INVENTION

This invention comprises a game board and playing pieces which permit a word game to be played in three dimensions. To this end, the game board is provided with a playing surface on which are arranged square bosses in a regular grid (waffle) pattern. The playing pieces are square, and each has a peripheral skirt about its lower edge and a peripheral shoulder about its upper edge. The playing pieces can be stacked on the game board, with the lower peripheral skirt nesting over a square boss of the board at a preselected location. The playing pieces can be stacked on each other with the peripheral skirt of the upper piece seating about the peripheral shoulder of the subjacent piece. This provides a vertical dimension to the game and permits stacking of the playing pieces in a very stable condition that resists toppling in the event the game board is jostled.

DESCRIPTION OF PREFERRED EMBODIMENTS

Figure 1:
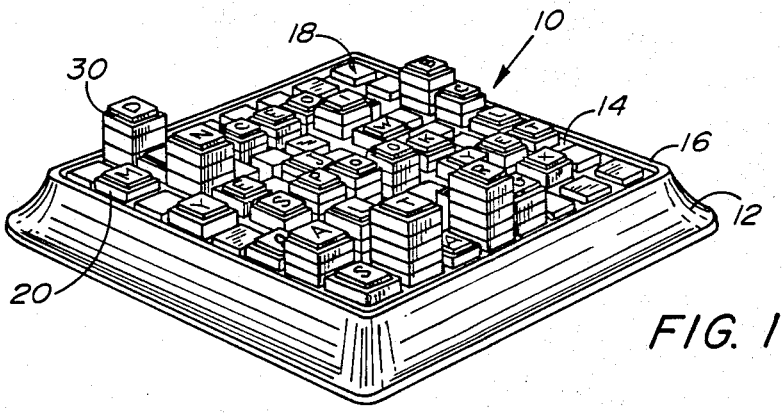
FIG. 1 is a front perspective view of a game with the playing pieces depicted on the game board of the invention.

Referring now to FIG. 1, the game board 10 is illustrated as it may appear during the progress of a game. The game board has a base 12 which is preferably formed with outwardly sloping sides, and a playing surface 14 which is recessed a slight distance below the upper edge 16 of the vertical sides, whereby the sides form a perimeter fence about the playing surface 14. The playing surface 14 is subdivided into a plurality of square bosses 18 which are disposed in an evenly distributed grid (waffle) pattern. The playing pieces such as 20 are deployed on the game board by placing them over the square bosses 18. As described hereinafter, the playing pieces 20 can also be stacked on each other to provide one or more vertical stacks 30 during the progress of the game.

Figure 2:
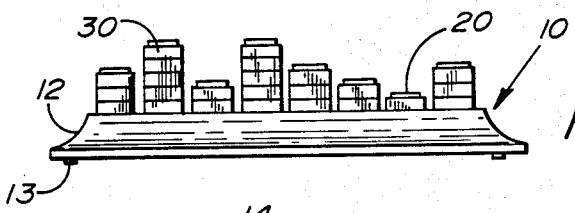
FIG. 2 is a side elevational view of the game board and playing pieces.

Referring now to FIG. 2, the board 10 is illustrated with the contoured sloping sides 15 and with feet 13. The playing pieces such as 20 are shown disposed in a plurality of stacks such as 30 on the playing surface 14.

Figure 3:
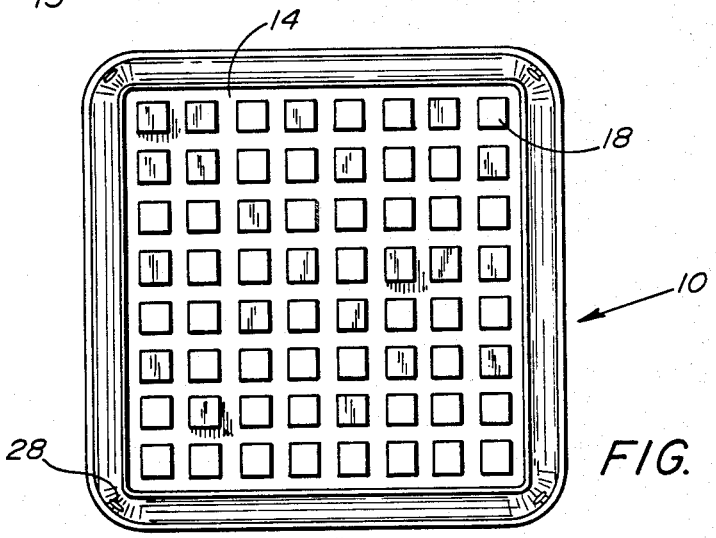
FIG. 3 is a bottom plan view of the game board.

Referring now to FIG. 3, the undersurface of the game board can be seen in plan view. As shown, the game board is square with a square playing surface 14 and a plurality of raised square bosses 18 which are all arranged in a regular grid pattern. The corners of the board 28 can be filleted with a smooth radius of curvature if desired.

Figure 4:
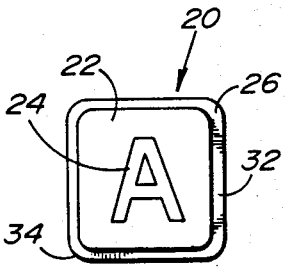
FIG. 4 is a top plan view of one of the identical playing pieces.
Figure 5:
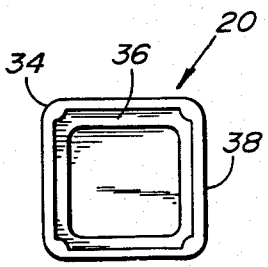
FIGS. 5 and 6 are bottom plan and side elevational views respectively of the FIG. 4 playing piece.
Figure 6:
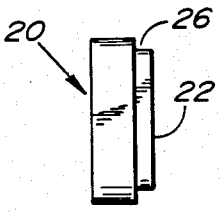

Each of the playing devices has the structure shown in FIGS. 4 through 6. Each playing piece 20 has a top surface 22 on which is depicted a letter 24. About its upper edge 26, the playing piece 20 has an inset shoulder 32. The corners of the playing piece can be rounded as shown at 34.

FIG. 5 illustrates the under surface 36 of the playing piece 20. As there illustrated, the playing piece 20 has a peripheral skirt 38 about its lower edge and this skirt 38 is sized sufficiently to permit placement of the skirt on the inset shoulder 32 of a subjacent playing piece, and over a square boss 18 of the game board 10. The inset shoulder 32 is better illustrated in FIG. 6 where the playing piece is shown in elevational side view.

The board is used in a word game in which each of the players draws an equal number, e.g., seven, playing pieces (letter tiles) from a draw pile of the letters. The players then attempt to form a word of two letters or more. Once the first word has been placed on the game board, the players sequentially place one or more of their playing pieces on the game board to form a new word which can connect to a word already on the board, or change a word already on the board to a different word. The word on a board can be changed by stacking one or more playing pieces on the playing pieces which comprise that word on the board. Words are formed to read across, left to right, or down the board, not diagonally and not upwardly. Any letter that is adjacent to another letter must form a word in the aforementioned directions. A player cannot stack more than one letter on the same vertical stack during one turn and there must be at least one letter from the original word remaining uncovered which is used in the new word formed by stacking.

The scoring can add interest and emphasize the stacking aspect of the game, with higher stacked letter tiles being awarded more points than lower stacked letter tiles.

The game board is ideally suited for the aforementioned game. The game board provides a very stable surface for stacking the playing pieces and the playing pieces interlock to the board to prevent their dislodgement in the event that the board is jostled. Furthermore, the playing pieces interlock as they are stacked on each other, thereby forming stacks which are very stable and resist tipping even when the board or table surface is jarred.

The invention has been described with reference to the illustrated and presently preferred embodiment. It is not intended that the invention be unduly limited by this disclosure of the presently preferred embodiment. Instead, it is intended that the invention be defined by the means, and their obvious equivalents, set forth in the following claims.

What is claimed is:

1. The combination of a game board having a square playing surface with a plurality of square bosses arranged in a symmetrical waffle pattern and a plurality of playing pieces of identical size and shape, each playing piece being formed with a square top and with an orthogonal peripheral skirt about its lower edge and a coacting peripheral shoulder about its upper edge and bearing a single letter indicia on the upper surface of its top, with said square bosses of said game board being sized and spaced apart sufficiently to be receive on adjacent bosses, said playing pieces with their peripheral skirts received over said bosses, and said peripheral skirts and said peripheral shoulders of the playing pieces being sized to permit said tops of said playing pieces to be received within and surrounded by the peripheral skirt of a playing piece placed thereon and thereby permit vertical stacking of said playing pieces at preselected locations on said board and on each other, to display word combinations of letters with varied vertical heights of letter stacks within a word.

2. The combination of claim 1 wherein said game board has vertical sides which extend slightly above the playing surface, thereby forming a perimeter fence about said playing surface and spaced apart from the adjacent outer rows of square bosses to permit placement of said playing pieces thereon.

3. The combination of claim 1 wherein said playing surface is supported on a base having concave and vertically inclined sides.

4. The combination of a game board having a square playing surface with a plurality of square bosses arranged in a symmetrical waffle pattern of 8 by 8 bosses and a plurality of playing pieces of identical size and shape, each playing piece being formed with a square top and with an orthogonal peripheral skirt about its lower edge and a coacting peripheral shoulder about its upper edge and bearing a single letter indicia on the upper surface of its top, with said square bosses of said game board being sized and spaced apart sufficiently to be receive on adjacent bosses, said playing pieces with their peripheral skirts received over said bosses, and said peripheral skirts and said peripheral shoulders of the playing pieces being sized to permit said tops of said playing pieces to be received within and surrounded by the peripheral skirt of a playing piece placed thereon and thereby permit vertical stacking of said playing pieces at preselected locations on said board and on each other, to display word combinations of letters with varied vertical heights of letter stacks within a word.

5. The combination of claim 4 wherein said game board has vertical sides which extend slightly above the playing surface, thereby forming a perimeter fence about said playing surface and spaced apart from the adjacent outer rows of square bosses to permit placement of said playing pieces thereon.

6. The combination of claim 4 wherein said playing surface is supported on a base having concave and vertically inclined sides.

* * * * *

UNITED STATES PATENT AND TRADEMARK OFFICE

CERTIFICATE OF CORRECTION

PATENT NO. : 4,776,597

DATED : October 11, 1988

INVENTOR(S) : Elliot A. Rudell

It is certified that error appears in the above-identified patent and that said Letters Patent is hereby corrected as shown below:

In claim 4, column 4, line 14, change "receive" to --received--

Signed and Sealed this

Twenty-first Day of March, 1989

*Attest:*

DONALD J. QUIGG

*Attesting Officer*

*Commissioner of Patents and Trademarks*